US008649542B2

(12) United States Patent
Huettinger

(10) Patent No.: US 8,649,542 B2
(45) Date of Patent: Feb. 11, 2014

(54) HEARING AID WITH AMORPHOUS LOUDSPEAKER SHIELDING

(75) Inventor: Simon Huettinger, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 319 days.

(21) Appl. No.: 13/073,162

(22) Filed: Mar. 28, 2011

(65) Prior Publication Data

US 2011/0235837 A1 Sep. 29, 2011

Related U.S. Application Data

(60) Provisional application No. 61/317,745, filed on Mar. 26, 2010.

(30) Foreign Application Priority Data

Mar. 26, 2010 (DE) ..... 10 2010 012 946

(51) Int. Cl.
*H04R 25/00* (2006.01)

(52) U.S. Cl.
USPC ..... 381/324; 381/312; 381/322

(58) Field of Classification Search
USPC ..... 381/312–331; 148/304
See application file for complete search history.

(56) References Cited

U.S. PATENT DOCUMENTS

| | | | | |
|---|---|---|---|---|
| 6,850,803 | B1 | 2/2005 | Jimenez et al. | |
| 8,170,681 | B2 | 5/2012 | Jimenez et al. | |
| 2006/0018495 | A1 | 1/2006 | Geschiere et al. | |
| 2008/0226108 | A1 | 9/2008 | Heerlein et al. | |
| 2009/0017279 | A1 | 1/2009 | Mizushima et al. | |
| 2010/0054513 | A1 * | 3/2010 | Bally et al. | 381/322 |
| 2010/0230010 | A1 | 9/2010 | Yoshizawa et al. | |
| 2010/0276193 | A1 | 11/2010 | Liu | |

FOREIGN PATENT DOCUMENTS

| | | | |
|---|---|---|---|
| DE | 102006043909 | B3 | 4/2008 |
| EP | 1903835 | A2 | 3/2008 |
| EP | 20115628 | A1 | 1/2009 |
| JP | 2008231533 | A * | 10/2008 |
| WO | 0197908 | A2 | 12/2001 |
| WO | 2009085660 | A2 | 7/2009 |
| WO | 2009123100 | A1 | 10/2009 |

OTHER PUBLICATIONS

Hilzinger, et al: "Amorphe und Nanokristalline Metalle", Spectrum der Wissenschaften, Jul. 1994, Germany. Statement of Relevance.

(Continued)

*Primary Examiner* — Duc Nguyen
*Assistant Examiner* — Matthew Eason
(74) *Attorney, Agent, or Firm* — Laurence A. Greenberg; Werner H. Stemer; Ralph E. Locher

(57) ABSTRACT

It should be possible to produce hearing aids in a simpler and more compact fashion. It is for this reason that a hearing aid is proposed, the loudspeaker device of which is shielded by a shielding device, more particularly a housing, which can shield both high-frequency and low-frequency electromagnetic fields. The shielding device is at least in part made of an amorphous, soft-magnetic metal with a preferred direction of the nanocrystalline structures. Using this, a plurality of separate shielding elements can be dispensed with and a hearing aid can have a smaller embodiment.

8 Claims, 2 Drawing Sheets

(56) References Cited

OTHER PUBLICATIONS

Hitachi Metals Ltd., Tottori Works, "Amorphous Magnetic Shielding Tape", Technical Data Sheet No. F1VR0307, Oct. 2006.

Ulrich et al: "Hörakustik Theorie und Praxis", DOZ Verlag, Heidelberg, 1. Auflage, Oct. 2007, pp. 199-201, ISBN 978-3-922269-80-9, Germany. Statement of Relevance.

Egelkraut et al: "Polymer Bonded Soft Magnetics for EMI Filter Applications in Power Electronics", 25th IEEE Applied Power Electronics Conference and Exposition (APEC), Palm Springs, Feb. 21-25, 2010, pp. 231-238.

Herzer G: "Anisotropies in soft magnetic nonocrystaline alloys", Journal of Magnetism and Magnetic Mateirals, Elsevier Science Publishers, Amsterdam, NL, vol. 294, No. 2, Jul. 1, 2005, pp. 99-106, XP04929241.

* cited by examiner

HEARING AID WITH AMORPHOUS LOUDSPEAKER SHIELDING

CROSS-REFERENCE TO RELATED APPLICATION

This application claims the priority, under 35 U.S.C. §119 (e), of provisional application No. 61/317,745, filed Mar. 26, 2010; the application also claims the priority, under 35 U.S.C. §119, of German patent application No. 10 2010 012 946.1, filed Mar. 26, 2010; the prior applications are herewith incorporated by reference in their entirety.

BACKGROUND OF THE INVENTION

Field of the Invention

The present invention relates to a hearing aid with a signal-recording device, a signal-processing device for processing a signal from the signal-recording device, a magnetically operated loudspeaker device, which converts an output signal from the signal-processing device into an output sound, and a shielding device, which is arranged between the loudspeaker device and the signal-processing device for reducing electromagnetic interference on the signal-processing device by the loudspeaker device.

Hearing aids are portable hearing apparatuses used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing unit. This basic configuration is illustrated in FIG. 1 using the example of a behind-the-ear hearing aid. One or more microphones 2 for recording the sound from the surroundings are installed in a hearing-aid housing 1 to be worn behind the ear. A signal-processing unit 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the equipment wearer using a sound tube, which is fixed in the auditory canal with an ear mold. A battery 5, likewise integrated into the hearing-aid housing 1, supplies the hearing aid and, in particular, the signal-processing unit 3 with energy.

For design reasons, amplifier, receiver (loudspeaker) and antennas for the wireless communication are usually arranged very close together in a hearing aid, and so these components interfere with one another much more strongly than in other applications that use similar components. In a hearing aid, interference in the wireless communication as a result of electromagnetic radiation from the receiver in the communication frequency band and interference in the amplifier as a result of electromagnetic radiation from the receiver in the audio frequency band are particularly critical.

The aforementioned problem does not occur in a cellular phone, for example, because the communication frequency band in the hearing aid is generally very low (e.g. 3 MHz), whereas it lies at e.g. 900 MHz in a cellular phone. Hence the harmonics from the loudspeaker in the communication frequency band play a smaller role in cellular phones than in hearing aids.

The influence of the receiver or loudspeaker on the remaining signal processing is also lower in a cellular phone than in a hearing aid because the power of the receiver in a hearing aid is always greater than in a cellular telephone. This is due to the fact that a hearing aid has to generate sufficiently high levels in order also to be able to compensate for a loss of hearing.

The datasheet "TECHNICAL DATA, Amorphous Magnetic Shielding Tape" from Hitachi Metals, Ltd., dated Oct. 16, 2006, has disclosed an amorphous magnetic shielding tape. This shielding tape consists of five layers: a substrate paper, an amorphous metal tape and a PET film, with an adhesive layer respectively situated therebetween. The shielding tape can be used for the reduction of electromagnetic influences.

Moreover, the article by Sven Egelkraut et al.: "Polymer Bonded Soft Magnetics for EMI Filter Applications", Automotive Power Electronics, Mar. 25 and 26, 2009, Paris, describes a polymer-bonded, soft-magnetic material for magnetic core applications and EMI filters.

Finally, U.S. Pat. No. 6,850,803 B1 discloses an implantable medical device with a shielded charging coil. The secondary coil of the charging device is shielded on the distal side in order to improve the charging efficiency.

According to an article by Hans-Rainer Hilzinger et al., titled "Amorphe and nanokristalline Metalle" [Amorphous and Nanocrystalline Metals], published in Spektrum der Wissenschaft [German edition of Scientific American] in July 1994, amorphous metals are produced by very rapid cooling. As a result of the rapid cooling, the metal atoms remain in a largely disordered state. The amorphous structure resulting therefrom leads to a high electric resistance and to soft-magnetic behavior. By way of example, the utilized metal is in the form of alloys, in which 70 to 85% of atoms are transition metals such as iron, cobalt and nickel, and 15 to 30% of atoms are metalloids such as silicon or boron. In these compositions, the energy in the crystalline state is hardly lower than in the molten mass. Therefore, there is only a weak tendency toward crystallization.

Hearing aids currently usually utilize receivers that are shielded from radiation in the audio frequency range by a housing made of so-called mu-metal. Additionally, a shielding foil of copper may be placed around the receiver in order to improve the shielding effect in the communication frequency band. The shielding by mu-metal only has little effect in this higher frequency range as a result of the high permeability and low conductivity. By contrast, copper only provides insufficient shielding against magnetic radiation or low frequencies. This means that both types of shielding are required.

SUMMARY OF THE INVENTION

It is accordingly an object of the invention to provide a hearing aid with amorphous loudspeaker shielding which overcomes the above-mentioned disadvantages of the prior art devices of this general type, which simplifies the shielding of a receiver in a hearing aid.

According to the invention, the object is achieved by a hearing aid with a signal-recording device, a signal-processing device for processing a signal from the signal-recording device, a magnetically operated loudspeaker device, which converts an output signal from the signal-processing device into an output sound, and a shielding device. The shielding device is arranged between the loudspeaker device and the signal-processing device for reducing electromagnetic interference on the signal-processing device by the loudspeaker device. The shielding device is at least in part made of an amorphous, soft-magnetic metal with a preferred direction of the nanocrystalline structures.

Advantageously, the amorphous, soft-magnetic metal with preferred direction (anisotropy) can shield both electric and magnetic fields. Hence, only a single material or a single shielding element is required for shielding in the hearing-aid communication frequency band (e.g. at 3 MHz) and for shielding in the audio frequency range. This can significantly simplify the design of a hearing aid that contains a wireless communication connection.

Thus, the signal-processing device of the aforementioned hearing aid preferably has a transmission unit, and the shielding device is mainly arranged between the loudspeaker device and the transmission unit for protecting the latter. This can reduce the influence of the loudspeaker device on the transmission unit.

It is particularly advantageous for the shielding device to form the housing of the loudspeaker device. What this can achieve is that there is good shielding of the loudspeaker device in all spatial directions and, moreover, there is no need for a separate shielding device in addition to the housing of the loudspeaker device.

Specifically, the shielding housing can have a multi-layered design, with one layer thereof serving as a substrate on which a layer made of the amorphous metal is formed. This affords the possibility of producing a mechanically very stable housing.

Furthermore, the shielding device can be embodied such that it exhibits a significant shielding effect in the single-digit MHz-range. Thus, the shielding device is effective precisely in the frequency range that is typically used for wireless communication in hearing aids.

In a further preferred embodiment, the shielding device can have a preferred magnetic direction, which runs substantially parallel to a magnetic circuit of the loudspeaker device. As a result of this, the shielding effect is particularly pronounced against leakage fields from the magnetic circuit.

Furthermore, the shielding device can have a preferred electrical direction, which runs substantially perpendicular to a magnetic circuit of the loudspeaker device. This develops eddy currents, the orientation of which is likewise optimized in respect of reducing leakage fields.

In an advantageous embodiment, the hearing aid is embodied as an in-the-ear hearing aid. Such hearing aids require a particularly small installation space, and the double shielding effect of the amorphous metal (audio frequency range and communication frequency range) in a single shielding element is particularly expedient in this case.

Other features which are considered as characteristic for the invention are set forth in the appended claims.

Although the invention is illustrated and described herein as embodied in a hearing aid with amorphous loudspeaker shielding, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The exemplary embodiments described in more detail below constitute preferred embodiments of the present invention.

Figure 1:
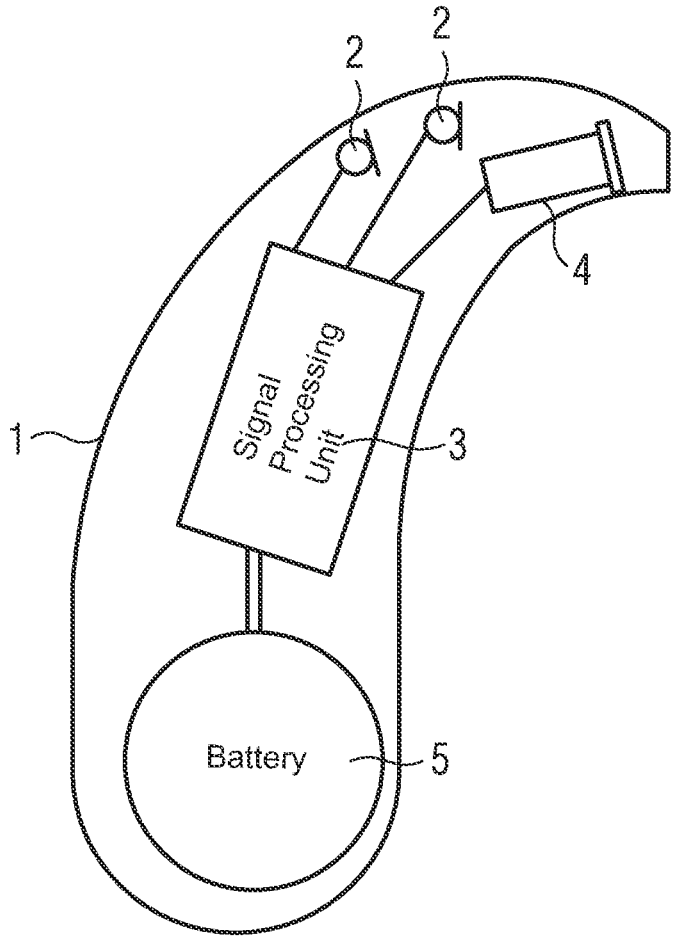
FIG. 1 PRIOR ART
FIG. 1 is a diagrammatic, illustration showing a basic design of a hearing aid according to the prior art.
Figure 2:
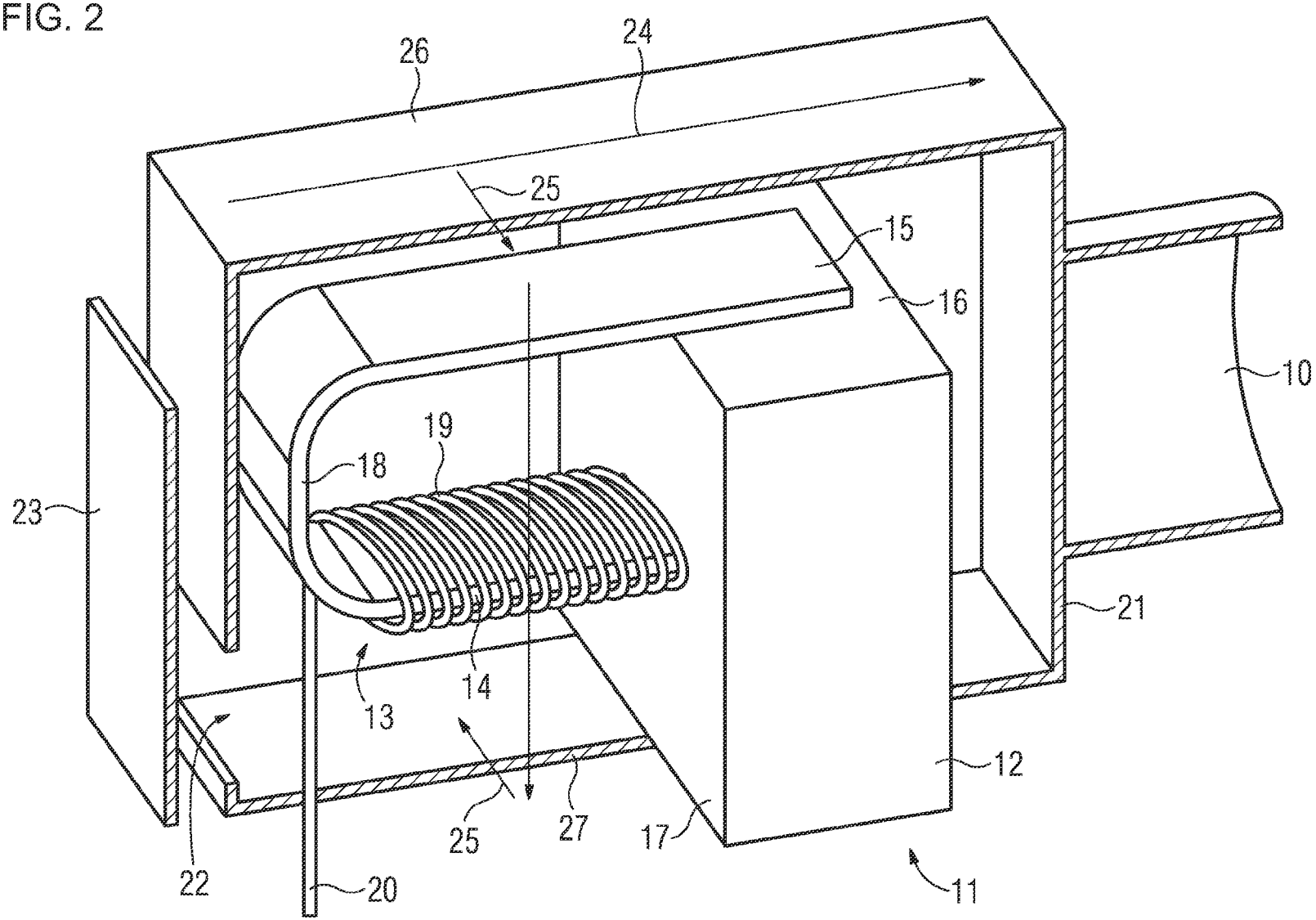
FIG. 2 is a diagrammatic, perspective view of an example of a receiver in a hearing aid as per the present invention.

Referring now to the figures of the drawing in detail and first, particularly, to FIG. 2 thereof, there is shown schematically a receiver in a hearing aid, as is utilized e.g. in a BTE hearing aid or an ITE hearing aid. The receiver constitutes the loudspeaker device of the hearing aid or is at least part thereof. It serves to produce an output sound of the hearing aid on the basis of a signal obtained from a hearing-aid-internal signal-processing device. The signal-processing device in turn typically contains an amplifier and possibly a filter and other signal-processing components. It obtains its input signal from a signal-recording device, which typically contains at least one microphone and/or an electromagnetic receiver, e.g. a coil.

Furthermore, a modern hearing aid usually contains a transmission device for wireless communication with an external device. The transmission device has e.g. an antenna or a coil for inductive transmission. The wireless communication is brought about e.g. in one or more frequency bands in the region of 3 MHz.

The exemplary receiver illustrated in FIG. 2 is an electrodynamic loudspeaker. Here, electric input signals are converted into oscillations of a membrane (not illustrated in FIG. 2). The oscillating membrane imparts oscillations onto the directly adjacent air, as a result of which the desired sound is produced. This sound leaves the receiver at a sound-outlet port 10. From there, the sound is directed to the eardrum of the hearing-aid wearer, either directly or with the aid of a sound-guiding tube.

For the electrodynamic conversion of an electric input signal into the sound output signal, the receiver in this case has a magnet arrangement 11, which converts the electric signal into mechanical oscillations. In the present case, the magnet arrangement has a hard-magnetic or soft-magnetic block 12, which has a cubic embodiment. A U-shaped, soft-magnetic metal section 13 is arranged on one of its sides. The metal section 13 has a first limb 14, which in this case projects perpendicularly from the metal block 12 and is fixedly connected to the latter. A second limb 15 of the U-shaped metal section 13 extends parallel to the first limb 14 and likewise parallel to a side 16 of the cubic metal block 12, which side is perpendicular to the side 17 from which the first limb 14 projects. There is a certain spacing between the limb 15 and the side 16 of the metal block 12 in the unloaded state.

The first limb 14 and the second limb 15 of the U-shaped metal section 13 are interconnected by an arc element 18. Since the metal section 13 is only fixedly connected to the metal block 12 with the first limb 14 and is free on its second limb 15, the latter can oscillate due to the spacing from the side 16 of the metal block 12.

A coil 19 is wound around the first limb 14; its connections 20 are guided downward in this case for reasons of simplicity. The coil 19 generates a magnetic flux through the first limb 14. The magnetic circuit is closed by the arc-shaped element 18, the second limb 15, the air gap between the second limb 15 and the metal block 12, and finally via the metal block 12 itself back to the first limb 14. If a current is applied to the coil 19, the metal block 12 attracts the free end of the second limb 15 with the rhythm of the magnetic flux or the electric signal, and so this free end carries out corresponding oscillations. The membrane (not illustrated) attached to the free end of the second limb 15 then produces the corresponding sound.

The magnet arrangement 11 utilized as transducer unintentionally also emits magnetic fields outward as interference fields. This even more so because high-power receivers, which have to compensate for a loss of hearing of a hearing-aid wearer, are utilized in hearing aids. These interference fields influence components in the vicinity of the receiver. Since hearing aids and, more particularly, ITE hearing aids may only take up a small installation space owing to the principles thereof, the remaining electrical components required in a hearing aid are situated relatively closely to the receiver. That is to say all electrical components can be influenced by the interference fields from the receiver.

The receiver is operated in the audio frequency range. However, this does not mean that interference-field components are only present in the audio frequency range. Rather, harmonics of the useful signal or the useful field are also generated as interference components. Thus, the magnet arrangement 11 typically also produces electromagnetic interference components in the frequency range of a few MHz (e.g. 3 MHz). However, e.g. an electromagnetic communication system integrated into the hearing aid also operates in this frequency range. Thus, if the hearing aid has an antenna or a coil for the wireless communication in the single-digit MHz range, interference components from the receiver can by all means have a significant influence on the communication system. The object is to effectively dampen these interference components.

Thus, in the example in FIG. 2, the magnet arrangement 11 has been installed in a housing 21, which at least in part is made of an amorphous, soft-magnetic metal of the type mentioned at the outset. The housing 21 completely surrounds the magnet arrangement 11. The sound-outlet port 10 is here integrally connected to the housing 21 and made of the same material as the housing 21 itself. There is an opening 22 in the housing 21 in the vicinity of the coil 19 of the magnetic transducer. The connection lines 20 of the coil 19 are led to the outside through this opening. In order to be able to ensure complete shielding despite the opening 22, there is an additional housing section 23 in front of the opening 22 in the emission direction.

The aforementioned structure of the receiver and, more particularly, also the housing 21, illustrated in FIG. 2, is merely exemplary. Moreover, in order to aid the understanding of the design of the receiver, the housing 21 in FIG. 2 has been illustrated in a half-opened fashion, and so the magnetic transducer situated therein can be identified.

Thus, the housing 21 constitutes a shielding device, which in this case is part of the loudspeaker device. Alternatively, e.g. a shielding foil, shielding tape or another shielding element can also be arranged between the receiver or loudspeaker device and every other signal-processing component of the hearing aid. All that is important is that the respective shielding device has the aforementioned amorphous, soft-magnetic metal.

The utilized amorphous, soft-magnetic metal moreover has a preferred direction for the nanocrystalline structures. This anisotropy leads to the shielding device (the housing 21 in the case of the example in FIG. 2) having a preferred magnetic direction 24 and a preferred electrical direction 25. The two preferred directions 24 and 25 are perpendicular to one another.

In this case, the housing 21 has a cubic shape. The individual walls of the housing run substantially parallel to the directly opposing sections of the magnetic circuit of the magnet arrangement 11. Thus, for example, the upper side 26 of the housing 21 runs parallel to the second limb 15 of the magnetic circuit. By way of example, the lower side 27 of the housing 21 likewise runs parallel to the directly facing first limb 14 of the magnetic circuit.

In the upper side 26 of the housing 21, the amorphous, soft-magnetic metal is formed such that the preferred magnetic direction 24 runs parallel to the second limb 15 and hence parallel to the magnetic flux guided therein. This can dampen low-frequency interference fields from the magnet arrangement 11.

As already indicated previously, the material of the housing 21 has a preferred electrical direction 25 perpendicular to the preferred magnetic direction 24. This means that the electric resistance is lower in this direction than in the direction orthogonal thereto. Since the housing 21 completely surrounds the magnet arrangement 11, this therefore forms an electric circuit around the magnet arrangement 11 in accordance with the preferred direction 25, the axis of which electric circuit is perpendicular to the axis of the magnetic circuit. Eddy currents can flow in this electric circuit, which eddy currents are induced in the housing 21 by the high-frequency interference components of the magnet arrangement. This leads to a corresponding outward shielding of the high-frequency components.

Thus, the problem of shielding both electric and magnetic fields is solved by amorphous, soft-magnetic metals with a preferred direction (anisotropy) of the nanocrystalline structure. Such materials, which, as a result of their improved processability, are utilized according to the invention as an alternative to mu-metal for shielding low-frequency alternating fields, have a high permeability in one spatial direction and at the same time are good conductors in the other spatial direction. Thus, as mentioned, the low-frequency magnetic field can be guided in one spatial direction, while the eddy currents, which ensure the shielding of high-frequency fields, can flow with little resistance.

Hence, the necessary shielding effect can advantageously be achieved using only one material. As a result, production steps can be dispensed with and the shielded receiver or the entire hearing aid can have a smaller build.

The shielding device or the housing 21 have the aforementioned amorphous, soft-magnetic metal with preferred direction of the nanocrystalline structures. Here, the metal can be applied/embedded onto or into one or more other material layers in the form of a metal layer. The multiple layers can support other material properties of the housing, e.g. increased rigidness, in a targeted fashion.

The invention claimed is:

1. A hearing aid, comprising:

a signal-recording device;

a signal-processing device for processing a signal received from said signal-recording device;

a magnetically operated loudspeaker device converting an output signal from said signal-processing device into an output sound, said loudspeaker device having a magnetic circuit; and a shielding device disposed between said loudspeaker device and said signal-processing device for reducing electromagnetic interference on said signal-processing device by said loudspeaker device, said shielding device is at least in part made of an amorphous, soft-magnetic metal with a preferred direction of nanocrystalline structures, said shielding device having a preferred magnetic direction, running substantially parallel to said magnetic circuit of said loudspeaker device, said shielding device having a preferred electrical direction, running substantially perpendicular to said magnetic circuit of said loudspeaker device, said shielding device guiding low-frequency magnetic fields in a specific spatial direction while eddy currents, ensuring a shielding of high-frequency fields, flow with little resistance.

2. The hearing aid according to claim 1, wherein:

said signal-processing device has a transmission unit; and said shielding device is mainly disposed between said loudspeaker device and said transmission unit for protecting said transmission unit.

3. The hearing aid according to claim 1, wherein said shielding device forms a housing of said loudspeaker device.

4. The hearing aid according to claim 3, wherein said housing has a multi-layered design, and one layer thereof serves as a substrate on which a layer made of the amorphous, soft-magnetic metal is formed.

5. The hearing aid according to claim 1, wherein said shielding device exhibits a significant shielding effect in a single-digit MHz-range.

6. The hearing aid according to claim 1, wherein said shielding device has walls running substantially parallel to directly opposing sections of said magnetic circuit.

7. The hearing aid according to claim 1, wherein said shielding device completely surrounding said magnetic circuit and thus forming an electric circuit around said magnet circuit in accordance with the preferred electric direction, an axis of said electric circuit being perpendicular to an axis of said magnetic circuit.

8. The hearing aid according to claim 1, wherein the hearing aid is an in-the-ear hearing aid.

* * * * *